United States Patent [19]

Gaines

[11] Patent Number: 4,474,243

[45] Date of Patent: Oct. 2, 1984

[54] METHOD AND APPARATUS FOR RUNNING AND CEMENTING PIPE

[75] Inventor: Christopher M. Gaines, Kuala Lumpur, Malaysia

[73] Assignee: Exxon Production Research Co., Houston, Tex.

[21] Appl. No.: 364,541

[22] PCT Filed: Oct. 6, 1980

[86] PCT No.: PCT/US80/01312

§ 371 Date: Mar. 26, 1982

§ 102(e) Date: Mar. 26, 1982

[87] PCT Pub. No.: WO82/01211

PCT Pub. Date: Apr. 15, 1982

[51] Int. Cl.[3] ..... E21B 33/14; E21B 7/18; E21B 7/12

[52] U.S. Cl. ..... 166/362; 166/285; 166/242; 175/67; 175/171; 405/236; 405/248

[58] Field of Search ..... 166/362, 285, 290, 157, 166/242; 175/67, 22, 171, 422; 405/240, 248, 233, 236

[56] References Cited

U.S. PATENT DOCUMENTS

| | | | |
|---|---|---|---|
| 340,035 | 4/1886 | Douglass | 175/422 |
| 1,003,284 | 9/1911 | Martin | 175/422 |
| 1,831,209 | 11/1931 | Thornley et al. | 175/422 |
| 2,838,120 | 6/1958 | Allmendinger et al. | 175/422 |
| 3,086,591 | 4/1963 | Sexton | 166/290 |
| 3,262,508 | 7/1966 | Price | 175/422 |
| 3,842,608 | 10/1974 | Turzillo | 405/236 |
| 3,934,652 | 1/1976 | Cochran | 166/285 |
| 4,250,966 | 2/1981 | Streich et al. | 166/285 |
| 4,397,588 | 8/1983 | Goughnour | 405/233 |

FOREIGN PATENT DOCUMENTS

| | | |
|---|---|---|
| 884756 | 11/1971 | Canada . |
| 324655 | 9/1920 | Fed. Rep. of Germany . |
| 614591 | 12/1948 | United Kingdom . |

*Primary Examiner*—Stephen J. Novosad
*Assistant Examiner*—Hoang C. Dang
*Attorney, Agent, or Firm*—John S. Schneider

[57] ABSTRACT

A jet shoe, connected to the lowermost end of a large diameter pipe to be placed in a subsea formation, comprises a cylindrical housing in which is arranged an inner tubular receptacle, a check valve permitting downward flow but preventing upward flow and jet tubes extending from the receptacle through the lower end of the jet shoe. The receptacle, valve and tubes are cemented in the housing. The tubes contain nozzles for jetting fluid to erode formation ahead of the shoe. A stinger arranged on the lower end of a smaller diameter pipe extends into and seals in the receptacle. A closure member on the smaller pipe closes off the upper end of the larger pipe. The smaller pipe and the larger pipe, together with a permanent guide base connected to the upper end of the larger pipe, are lowered to the ocean floor. While jetting fluid through the smaller pipe and out the shoe the formation ahead of the shoe is eroded until the larger pipe reaches a pre-determined depth. Cement slurry is then pumped downwardly through the smaller pipe and through the jet shoe to cement the larger pipe in the subsea formation.

18 Claims, 13 Drawing Figures

FIG. 5.
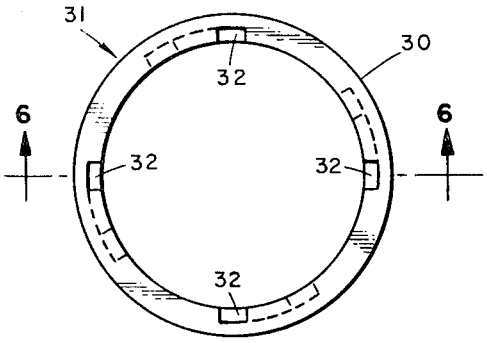
FIG. 7.
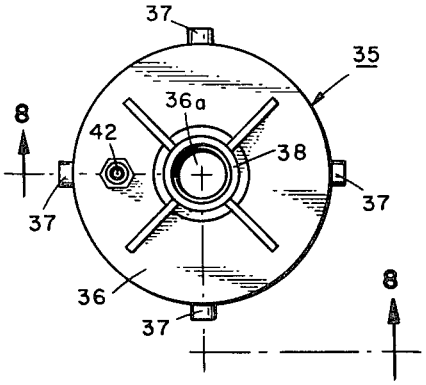
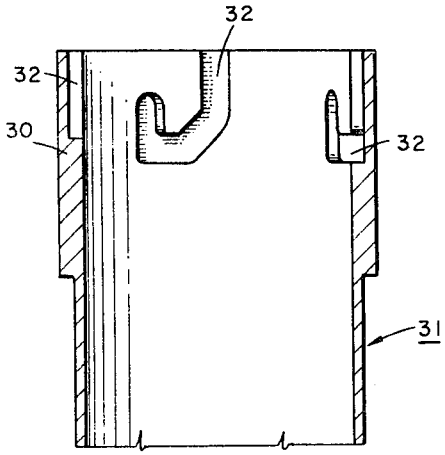
FIG. 6
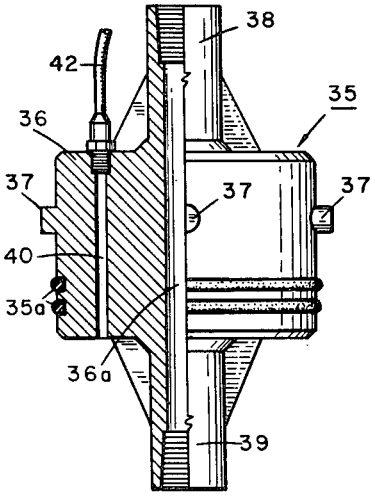
FIG. 8.

METHOD AND APPARATUS FOR RUNNING AND CEMENTING PIPE

TECHNICAL FIELD

The present invention concerns running and cementing pipe in subsea formations and, in particular, running and cementing in the subsea floor the first pipe string (structural pipe) run in an offshore well drilling operation.

BACKGROUND ART

In conventional methods for running structural casing in offshore drilling operations, a temporary guide base is lowered on guide lines from the surface of the water and placed on the ocean floor. An opening through the center of the guide base is positioned over the site of the well to be drilled and serves as a re-entry means to the well site. A string of drill pipe having a drill bit on the lower end thereof is then lowered through the opening in the guide base and a hole is drilled into the ocean floor to the setting depth of the structural pipe string. The guide lines are used to guide the drill string to the opening in the guide base. The drill pipe is removed from the drilled hole to the water's surface. Structural casing is then lowered through the opening in the temporary guide base and into the drilled hole, guided by the guide lines, on drill pipe by means of a suitable running tool connected to the lower end of the drill pipe and releasably connected to the structural casing. A permanent guide base is attached to the upper end of the casing pipe. Once the structural casing has been set it is cemented in place. The running rool is released from the structural casing string and removed along with the drill string to the water's surface.

In a location that has a soft unstable, unconsolidated ocean floor the temporary guide base may settle below the ocean floor rendering it useless as a reentry means. For this reason and also, because of other problems such as, severe hole instability and loss of drilling fluid (used to control formation pressure and to clean and stabilize the well bore) into the formation, this method for running and cementing structural casing strings is not satisfactory in such locations.

The present invention overcomes these problems by allowing the structural casing string to be cemented in place prior to releasing it from the drill pipe running string thereby eliminating the need for drilling a hole prior to running the structural casing string. Further, the invention eliminates the need for running a temporary guide base. This feature makes this invention also advantageous for use in normal, firm bottom water locations. Considerable rig time is saved by eliminating the running of a temporary guide base when running pipe in either type location.

DISCLOSURE OF INVENTION

The apparatus for running and setting large diameter (structural) pipe in accordance with the invention includes a jet shoe which is connected into the end of the large pipe. The shoe comprises a cylindrical member which contains an inner receptacle provided with an upper seat, a polished bore, a check valve and a chamber. A plurality of open-ended jet tubes connect to the chamber at their upper ends and extend to the lower end of the shoe at their lower ends. Nozzles are located in the ends of the tubes which are arranged to facilitate washing formation away from in front of the shoe to form the hole for the large pipe. The receptacle and the tubes are cemented in place in the shoe with the upper end of the receptacle and the lower end of the tubes forming continuous flow paths through the valve.

A stinger sub is connected to the lower end of a smaller diameter (drill) pipe. The stinger contains seals, is insertable into the receptacle and seals off against the polished bore of the receptacle. The smaller pipe also contains a closure member which releasably and sealingly engages the upper end of the larger pipe string. A permanent guide base is also connected to the upper end of the larger pipe string. The smaller pipe also contains a bumper sub, a telescoping section, for spacing-out purposes. The closure member may be provided with an opening to which a hose is connected for measuring at the surface pressures within the larger pipe.

The method in accordance with the invention includes the steps of lowering the larger pipe string on the smaller pipe string from the water's surface to the ocean floor and pumping fluid through the smaller pipe string and out through the jet shoe connected to the lower end of the larger pipe string while lowering the pipe strings until the predetermined setting depth for the larger pipe string is reached. Cement slurry is then pumped through the smaller pipe string and the jet shoe to cement the larger pipe string in place. The smaller pipe string is then disconnected from the upper end of the larger pipe string and removed to the water's surface.

BRIEF DESCRIPTION OF DRAWINGS

FIG. 5 is a plan view of the uppermost end of the structural casing;

FIG. 6 is a view taken along lines 6—6 of FIG. 5;

FIG. 7 is a plan view of the closure member mounted on the drill string;

FIG. 8 is a view taken along lines 8—8 of FIG. 7;

BEST MODE FOR CARRYING OUT THE INVENTION

Figure 1:
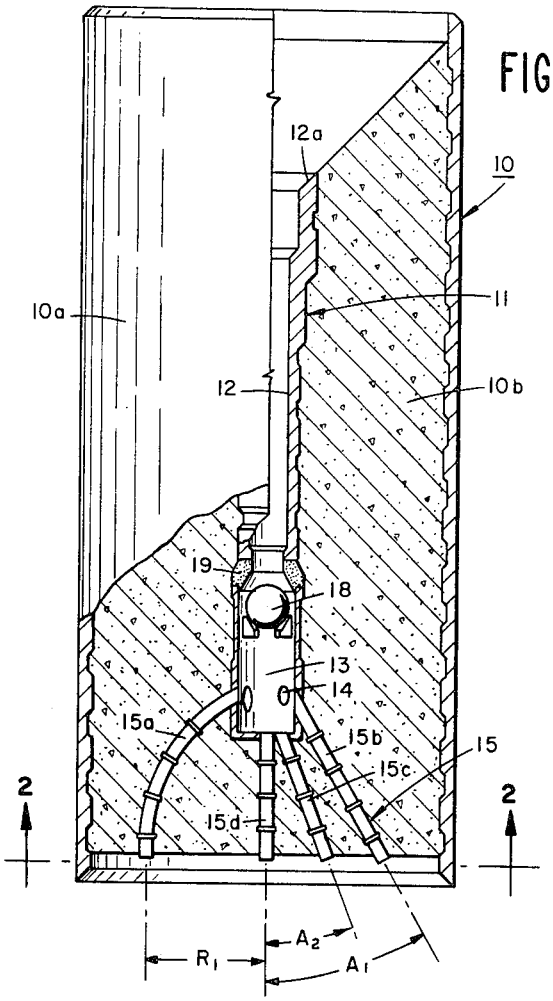
FIG. 1 is a vertical, partly sectional view of the jet shoe of the invention.
Figure 2:
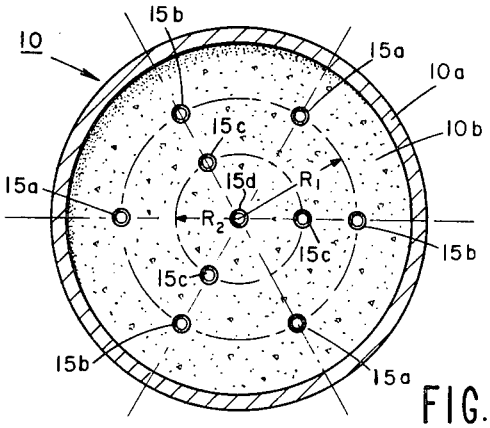
FIG. 2 is a view taken along lines 2—2 of FIG. 1.
Figure 4:
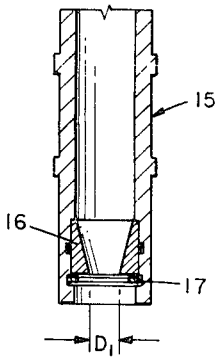
FIG. 4 is a sectional view illustrating the nozzle end of one of the jet tubes.

FIGS. 1 and 2 illustrate a jet shoe 10 formed by cylindrical housing 10*a* which contains an inner centrally located tubular receptacle 11, the inside diameter of which forms a polished bore 12. The upper end of receptacle 11 forms a seat 12*a*. The lowermost end of receptacle 11 forms an outlet chamber 13 containing openings 14 to each of which is connected a jet tube 15. The tubes are preferably arranged in a concentric ring pattern. The tubular receptacle and tubes are maintained in place by cement 10*b*. Three of the outer ring tubes 15*a* are curved to a vertical end and three of the outer ring tubes 15*b* extend at an angle. They are alternately positioned as shown in FIG. 2. The three inner ring tubes 15*c* extend at an angle and the center tube 15*d* extends vertically. As seen in FIG. 4, each jet tube 15 contains a nozzle 16 which is insertable and held in place by a snap ring 17. Receptacle 11 also contains a back pressure ball check valve 18. The ball seats on a seat 19 to close off upward flow of fluids through the valve.

Figure 3:
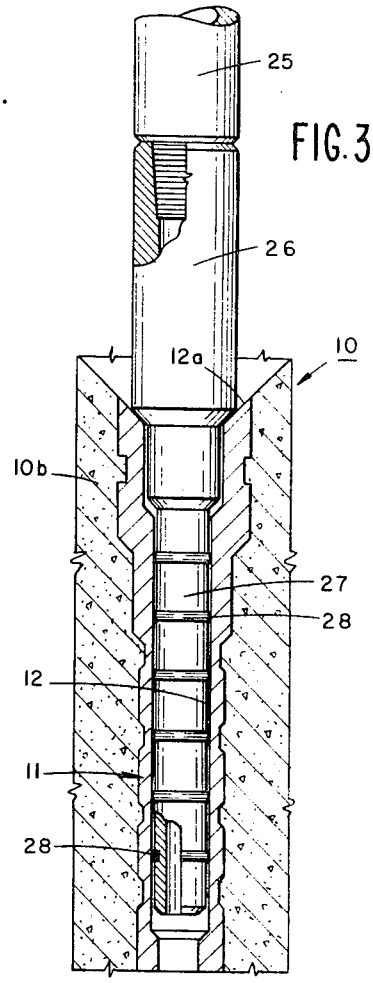
FIG. 3 is a vertical, partly sectional view illustrating the stinger portion of a drill pipe sub positioned in the receptacle of the jet shoe.

As seen in FIG. 3, the lower end of a drill pipe 25 is threaded into a drill pipe sub 26 which is provided with a stinger 27 shown positioned in receptacle 11. Stinger 27 is provided with a series of spaced-apart seals 28 which seal off against the bore 12 of receptacle 11.

As shown in FIGS. 5 and 6 the upper end 30 of a structural casing pipe 31 contains a plurality of J-slots 32 spaced about the inner wall of upper end 30 of the structural casing pipe.

Referring now to FIGS. 7 and 8 a closure member 35 includes a cylindrical member 36 containing spaced-apart lugs 37 which are engageable in J-slots 32 of the structural casing pipe. Tubular members 38 and 39 connect into the drill pipe on each side of closure member 36. Tubular members 38 and 39 and bore 36*a* of member 36 form a continuous passageway. Seals 35*a* are arranged on the outer surface of closure member 36 for sealing on the inner surface of structural casing 31. An opening 40 may be formed in member 36 to which may be attached a hose or line 42 which extends to the water's surface.

Figure 9:
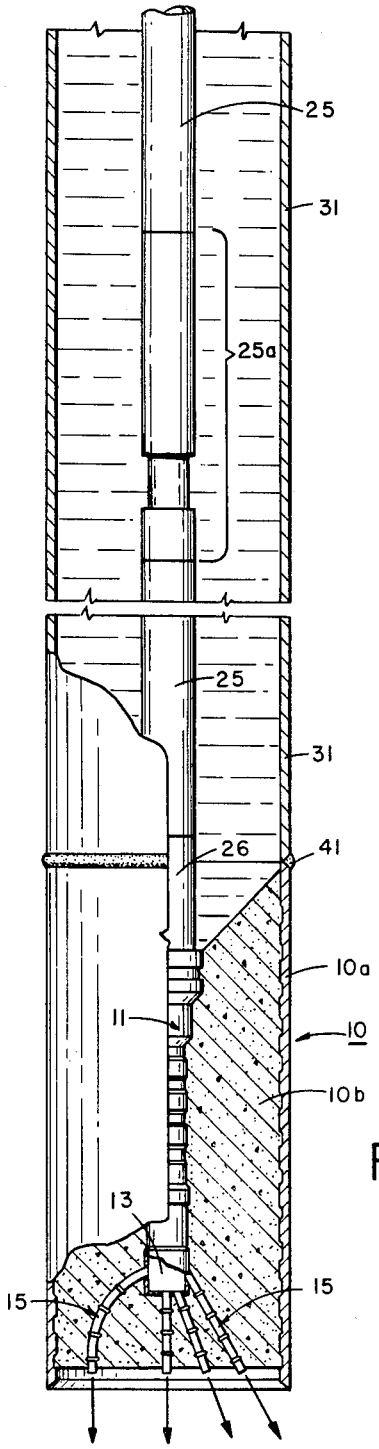
FIG. 9 is a vertical, partly sectional view of the structural casing, jet shoe and the arrangement of the drill pipe and stinger in the structural casing and jet shoe.
Figure 9A:
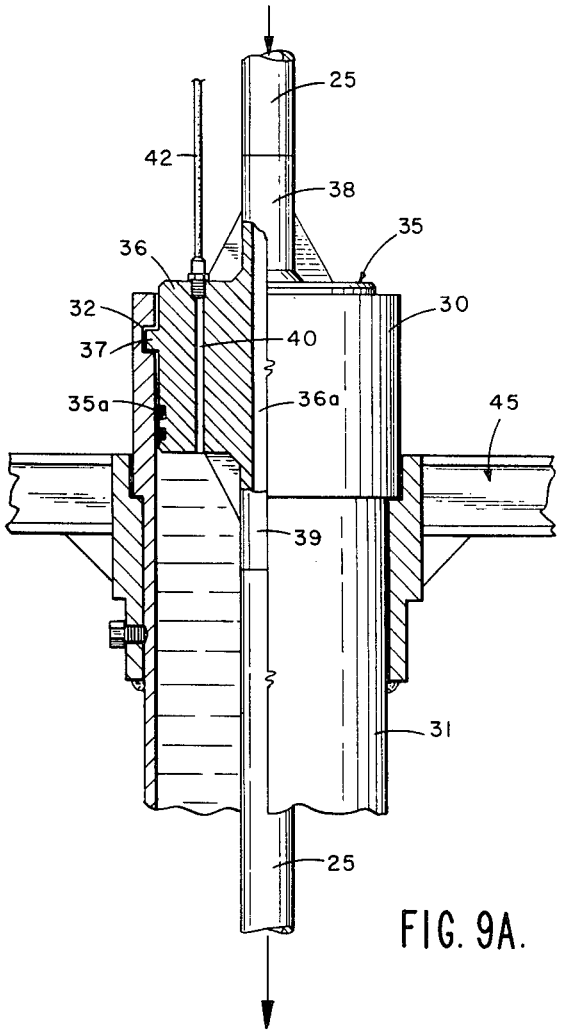
FIG. 9A is a vertical cross-sectional view of the uppermost end of the structural casing showing the drill pipe and closure member arranged within the structural casing and a permanent guide base attached to the upper end of the structural casing.

The manner in which jet shoe 10, structural casing 31, drill pipe 25 and closure member 35 are arranged is illustrated in FIGS. 9 and 9A. Jet shoe 10 is connected, preferably welded, to the lower end of structural casing 31, as indicated at 41. Drill pipe 25 includes a conventional bumper sub 25*a* to permit proper spacing out of the drill pipe between closure member 35 and stinger seat 12*a*. Closure member 35 is connected into the upper end 30 of structural casing 31 and seals 35*a* seal off the inner surface on that upper end. A permanent guide base, indicated at 45, is mounted on the upper end of casing 31.

Housing 10*a* may be a thirty inches outside diameter cylinder for use with a thirty inches outside diameter casing pipe 31. The tubes are preferably one and one quarter inches outside diameter. Six of the tubes are positioned on an eighteen inch bow circle at sixty degree spacing. Three of the tubes 15*a* on the eighteen inch bow circle are vertical and the other three tubes 15*b* are angled at thirty degrees ($A_1$) from vertical. Three of the tubes 15*c* are on a ten inch bow circle at a one hundred and twenty degree spacing. The tenth tube 15*d* is at the center of the shoe. The three tubes on the ten inch bow circle are angled at twenty degrees ($A_2$) from vertical. The three tubes on the ten inch bow circle are in line with the three tubes at thirty degrees on the eighteen inch bow circle. The center tube is vertical. The jet nozzles are typical, snap ring type nozzles and are inserted into one and one quarter inch diameter aluminum tubing flow paths. All of the aluminum flow paths are connected to the main flow path of the shoe in chamber 13 at or below the center line of the valve 18. The outlets of the six tube ring are on a nine inch radius $R_1$ circle. The outlets of the three tube ring are on a five inch radius $R_2$ circle. The outlet diameter $D_1$ of nozzle 16 is preferably one-half inch. All of the internal flow paths for this illustrative embodiment of the invention are rated for at least three thousand psi working pressure. The side of the jet shoe extends approximately two inches below the cement and outer tube ends. When used with a thirty inch outside diameter structural casing the overall length of the shoe may be 59 inches. The cement 10*b* in the jet shoe is tapered at its upper end to facilitate entry of stinger 27 of the drill pipe. All of the materials in the jet shoe are readily drillable.

Figure 10:
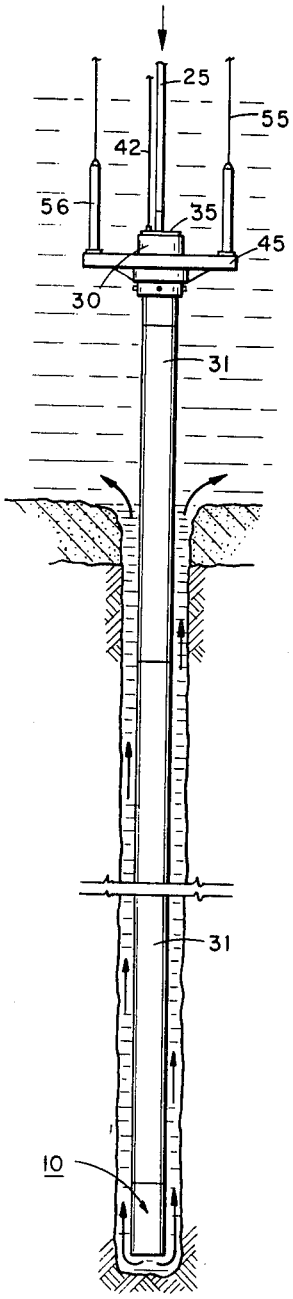
FIGS. 10, 11 and 12 illustrate the steps of running and cementing the structural casing in the ocean floor.
Figure 11:
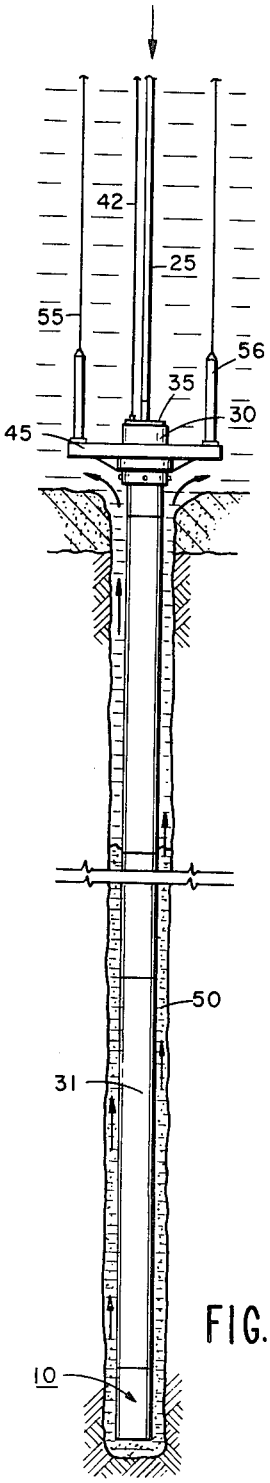
Figure 12:
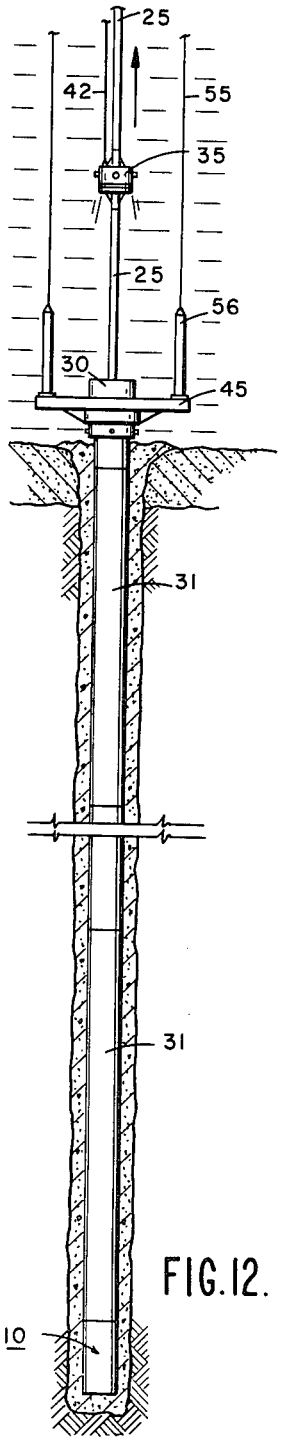

In conducting the method for running and cementing-in structural casing string 31 jet shoe 10 is welded to the lowermost joint of the casing string. After all of the casing joints have been connected, the string of drill pipe 25 is run inside the casing string until stinger 27 has been stabbed into receptacle 11 in jet shoe 10. Casing string 31 is kept filled with water to balance hydraulic pressures and prevent collapse of the casing string. Closure member 35 is made up on the top of the casing string 31 by engaging lugs 37 in J-slots 32. Hose 42 connects to opening 40 and extends to the water's surface for monitoring pressure inside casing 31 during jetting to detect possible leaks of drilling fluid through the bumper sub seals and/or seals 28 on stinger 27. Those seals retain pressure in drill string 25 and receptacle 11. Permanent guide base 45 is connected to the top of the casing string 31 and the casing string is lowered on drill pipe 25 to the ocean floor. Guide lines 55 are connected to guide posts 56 which are mounted on guide base 45. The casing string is jetted through the unconsolidated formation sediments by pumping drilling fluid down the drill pipe and through jet nozzles 16 in tubes 15 as shown in FIG. 10. The jet nozzles allow sufficient fluid flow rates and provide sufficient impact force to erode the formation directly ahead of shoe 10. All mud returns are taken outside of the casing pipe and all jetting pressure is confined to the inside of the drill pipe 25. When casing string 31 reaches total setting depth, cement slurry 50 as indicated in FIG. 11, is pumped down drill pipe string 25 through jet tubes 15 and up around the borehole surrounding casing pipe string 31 to provide sufficient skin friction to hold the casing pipe string in place after it is released from the running drill pipe string. FIG. 12 shows drill pipe string 25 disconnected from the upper end of casing pipe string 31 and in the process of being removed from casing pipe 31.

Significant features of the invention include (1) incorporation of jet nozzles into a pipe shoe; (2) providing means to assure that all pumped and jetted fluid and cement returns are confined to the outside of the pipe string and (3) providing means to jet a pipe string into place, pump cement through it while holding it in place with a running pipe string until the cement develops sufficient compressive strength and permitting release of the running pipe string without the possibility of cementing the running pipe string into the pipe shoe.

The invention eliminates the shallow hole instability problems in soft, unstable ocean floor deep water locations and saves significant amounts of tangible and intangible drilling costs. The invention is applicable in soft bottom, locations with shallow hole instability problems and, in addition, is applicable to normal, firm bottom locations as an alternative to running a temporary guide base. Eliminating the temporary guide base saves rig time.

While the invention has been described and illustrated with respect to running and cementing well pipe and, particularly, structural casing pipe it has other applications, as for example, it may be used in running and cementing pipe used as subsea pilings. Also, other tube patterns may be employed. For example, seven tubes, instead of ten tubes, may be used in which six outer tubes are on an eighteen inch bow circle and are angled to provide internal flow paths at forty five degrees from vertical. The seventh tube is a vertical center tube.

Changes and modifications may be made in the specific illustrative embodiments of the invention shown and described herein without departing from the scope of the invention as defined in the appended claims.

Having fully described the apparatus, method of operation, objects and advantages of my invention, I claim:

1. Apparatus for use in conducting offshore drilling operations comprising:

a vertically extending large pipe;

a housing connected to the lower end of said large pipe;

a vertically extending receptacle positioned in said housing and having an open upper end;

a valve arranged in said receptacle permitting flow of fluids only downwardly through said receptacle;

a plurality of open-ended tubes forming flow paths extending from said receptacle below said valve to the lower end of said housing, said tubes containing nozzles arranged for jetting fluid only downwardly from said tubes;

cement arranged in said housing cementing said receptacle and tubes in said housing; and a smaller pipe extending longitudinally through said large pipe;

a stinger arranged on the lower end of said smaller pipe for insertion into said receptacle, said stinger containing seal means for sealing off between the outer surface of said stinger and the inner surface of said receptacle;

means on said large pipe and said smaller pipe for releasably connecting said smaller pipe to said large pipe; and closure means on said smaller pipe for sealing off within said large pipe and preventing flow of fluids through said large pipe.

2. Apparatus as recited in claim 1 in which said large pipe comprises structural casing pipe and said smaller pipe comprises drill pipe.

3. Apparatus as recited in claim 2 including seal means for sealing said closure means on said casing pipe.

4. Apparatus as recited in claim 3 including pressure monitoring means attached to said casing pipe.

5. Apparatus as recited in claim 4 including a permanent guide base connected to the upper end of said casing pipe.

6. Apparatus as recited in claim 5 in which said housing is cylindrical and is substantially the same diameter as said casing pipe.

7. Apparatus as recited in claim 1 in which said means on said smaller pipe for releasably connecting said smaller pipe to said large pipe is arranged on said closure means.

8. Apparatus as recited in claim 7 in which the upper end of said cement is tapered.

9. A method for forming a borehole and cementing a casing pipe in said borehole in offshore drilling operations comprising:

lowering said casing pipe on drill pipe into the subsea floor while jetting fluid down through said drill pipe and out the ends of tubes formed in a jet shoe cemented to the lower end of said casing pipe without rotating said drill pipe and said casing pipe and while preventing return of said jetted fluid into said case pipe and drill pipe until said casing pipe has reached a predetermined depth in said formation;

pumping cement slurry downwardly through said drill pipe and said jet shoe tubes to cement said casing pipe in said subsea floor while preventing backflow of cement slurry into said casing pipe and drill pipe; and releasing and removing said drill pipe from said casing pipe.

10. A method for forming a borehole and cementing a casing pipe in said borehole in offshore drilling operations comprising:

lowering said casing pipe on a drill pipe into the subsea floor while jetting fluid down through said drill pipe and out the ends of tubes formed in a jet shoe cemented to the lower end of said casing pipe while preventing return of said jetted fluid into said casing pipe and drill pipe until said casing pipe has reached a predetermined depth in said formation, said drill pipe being releasably connected to said casing pipe; and pumping cement slurry downwardly through said drill pipe and said jet shoe tubes to cement said casing pipe in said subsea floor while preventing backflow of cement slurry into said casing pipe and drill pipe, the pressure in said casing pipe being monitored during jetting and cementing operations.

11. A method for running and cementing larger diameter pipe in a subsea formation comprising:

lowering said larger pipe on smaller diameter pipe from the water's surface while jetting fluid through said smaller pipe and out the end of a jet shoe cemented to the end of said larger pipe without rotating said smaller pipe and said larger pipe until said larger pipe has reached a predetermined depth in said formation;

pumping cement slurry through said smaller pipe and said jet show to cement said larger pipe in said formation; and releasing and removing said smaller pipe from said larger pipe.

12. Apparatus for use in running and cementing large diameter pipe in subsea formations comprising:

a cylindrical housing containing an open-ended receptacle extending from one end of said housing into said receptacle, a valve arranged at the interior end of said receptacle permitting flow of fluids in only one direction through said valve, and ten aluminum tubes forming flow paths extending from said valve to the other end of said housing, said tubes containing nozzles for jetting fluid therefrom;

a smaller diameter pipe extending from the water surface into said larger pipe and having a stinger for insertion into said receptacle, said stinger containing seal means for sealing off the outer surface of said stinger and the inner surface of said receptacle;

closure means on said smaller pipe for closing off the upper end of said larger pipe;

cement surrounding said receptacle, valve and tubes in said housing, one of said tubes being positioned in the center of said housing and extending vertically from said valve and the other tubes being positioned in concentric rings about said center tube, six of said tubes being on an eighteen inch bow circle at 60 degrees spacing and three of said tubes being on a ten inch bow circle at 120 degrees spacing, the outer rim of said housing extending beyond said cement and the ends of said tubes.

13. Apparatus as recited in claim 12 in which said larger pipe comprises structural casing pipe and said smaller pipe comprises drill pipe.

14. Apparatus as recited in claim 13 including seal means for sealing said closure means on said casing pipe.

15. Apparatus as recited in claim 14 including pressure monitoring means attached to said casing pipe.

16. Apparatus as recited in claim 15 including a permanent guide base connected to the upper end of said casing pipe.

17. Apparatus as recited in claim 16 including means for releasably connecting said closure means to said casing pipe.

18. Apparatus as recited in claim 17 in which the upper end of said cement is tapered.

* * * * *